US006912753B2

(12) United States Patent
Sin et al.

(10) Patent No.: US 6,912,753 B2
(45) Date of Patent: Jul. 5, 2005

(54) MANUAL FLOOR SWEEPER

(75) Inventors: Timmy Hok Yin Sin, Kowloon (HK); Chiu Fai Hui, Wong Tai Sin (HK); Kevin Kam Hoi Ma, Shatin (HK)

(73) Assignee: Techtronic Industries Co., Ltd., Tsuen Wan (HK)

( * ) Notice: Subject to any disclaimer, the term of this patent is extended or adjusted under 35 U.S.C. 154(b) by 0 days.

(21) Appl. No.: 10/728,093

(22) Filed: Dec. 5, 2003

(65) Prior Publication Data

US 2004/0205915 A1 Oct. 21, 2004

Related U.S. Application Data

(60) Provisional application No. 60/463,324, filed on Apr. 17, 2003.

(51) Int. Cl.[7] ..... A47L 11/32; A47L 11/33

(52) U.S. Cl. ..... 15/48.1; 15/41.1

(58) Field of Search ..... 15/40, 41.1, 42, 15/46, 48.1, 45, 52.1, 83; 192/43, 46; 476/15

(56) References Cited

U.S. PATENT DOCUMENTS 642,172 A * 1/1900 Sweitzer ..... 15/48.1
1,972,870 A * 9/1934 Christesen ..... 15/41.1
2,563,189 A * 8/1951 Rigby ..... 15/48.1
2,587,038 A * 2/1952 Goodell ..... 15/48
2,625,698 A * 1/1953 De Kadt et al. ..... 15/45
2,783,487 A * 3/1957 Luders ..... 15/41.1
3,602,932 A * 9/1971 Morris ..... 15/48.1
3,638,267 A * 2/1972 Liebscher ..... 15/41.1
4,007,508 A 2/1977 Ooyachi
4,823,422 A 4/1989 Yoshimura et al.
5,239,721 A 8/1993 Zahuranec

* cited by examiner

*Primary Examiner*—Gary K. Graham
(74) *Attorney, Agent, or Firm*—Leydig, Voit & Mayer, Ltd.

(57) ABSTRACT

A manual floor sweeper includes a housing and a brush roller mounted within the housing and rotatable in a sweeping direction. A first drive member is fixed to the brush roller. A second drive member is mounted rotatably with the housing and engagable with the first drive member. A drive carriage is movable between a first position for engaging the first drive wheel when the sweeper is moved in a first direction so as to rotate the brush roller in the sweeping direction and a second position when the sweeper is moved in a second direction for engaging the second drive member so as to move the brush roller in the sweeping direction.

1 Claim, 6 Drawing Sheets

MANUAL FLOOR SWEEPER

BACKGROUND TO THE INVENTION

1. Field of the Invention

The invention relates to manual floor sweepers

2. Background Information

Manual Floor Sweepers are well-known. They comprise a housing with a brush roller mounted therein. Four wheels are provided so that the housing can be pushed forwards and backwards across a floor. The brush roller has a drive wheel that engages at least one of the wheels. When the sweeper moves forwards across a floor surface the brush roller rotates in a first sweeping direction, and when sweeper moves backwards across the floor surface the brush roller rotates in a second sweeping direction. Either side of the brush roller are dust collection compartments for collecting dust when the brush roller moves in the first and second sweeping directions.

SUMMARY OF THE INVENTION

It is an object of the present invention to provide a manual sweeper in which the brush roller rotates in a single sweeping direction regardless of the direction of movement of the sweeper, and which requires only one dust collection compartment.

According to the invention there is provided a manual floor sweeper including:

a housing;

a brush roller mounted within the housing and rotatable in a sweeping direction;

a first drive member fixed to the brush roller;

a second drive member mounted rotatably with the housing and engagable with the first drive member;

a drive carriage movable between a first position for engaging the first drive member and a second position for engaging the second drive member so as to move the brush is roller in the sweeping direction when the sweeper is moved in the first or second directions.

Preferably, the drive carriage comprises a drive ring positioned about the first and second drive members and mounted rotatably with the housing for rotation in a first direction when the sweeper is moved in a first direction and rotation in a second direction when the sweeper is moved in a second direction.

Preferably, the drive ring includes a drive wheel for supporting the housing on a floor surface and for rotating the drive ring in the first and second directions.

Preferably, the drive carriage comprises a bogie having two axles and a wheel mounted at ends of each axle.

Further aspects of the invention will become apparent from the following description, which is given by way of example only.

BRIEF DESCRIPTION OF THE DRAWINGS

An embodiment of the invention will now be described by way of example only and with reference to the accompanying drawing, in which.

DESCRIPTION OF THE PREFERRED EMBODIMENT

Figure 1:
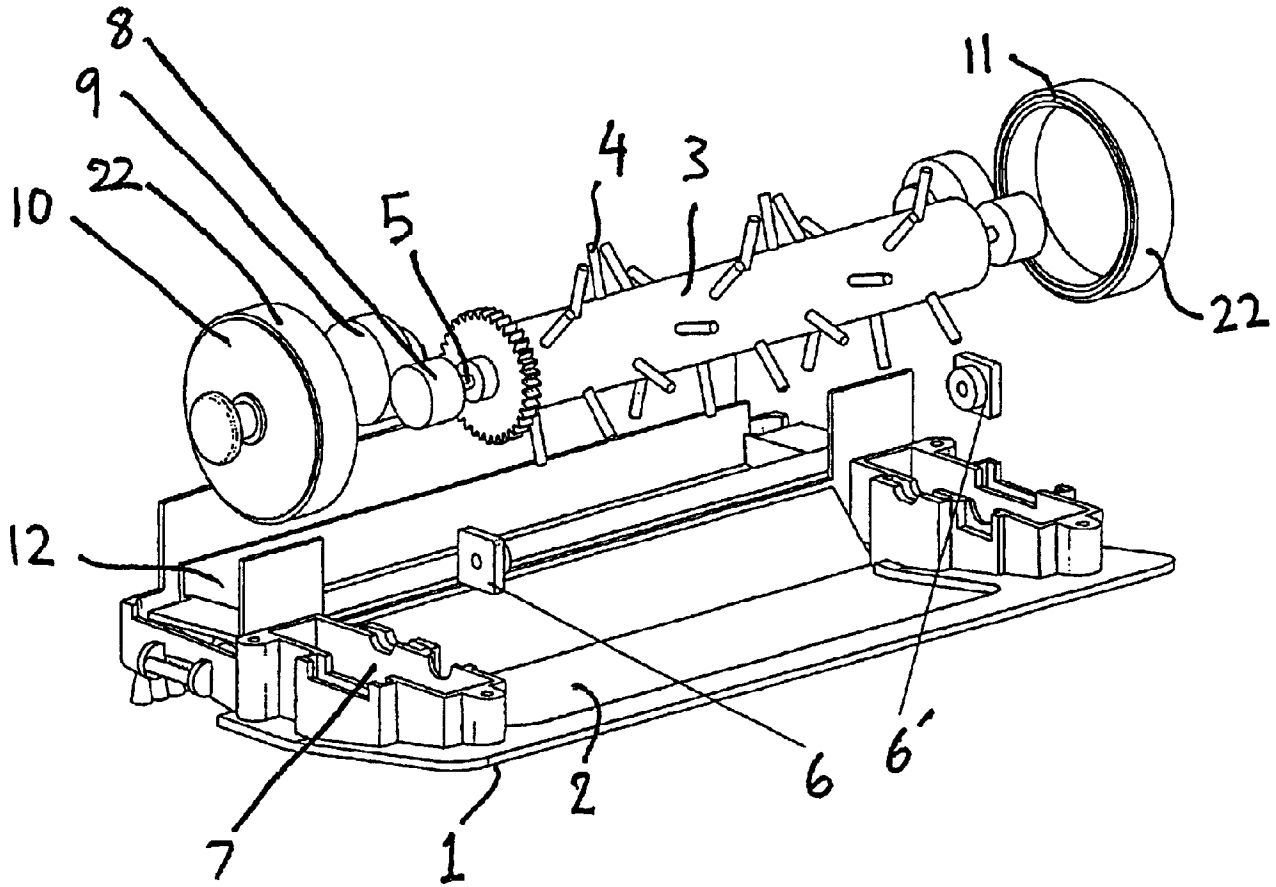
FIG. 1 is an exploded view of a floor sweeper according to the invention.
Figure 2:
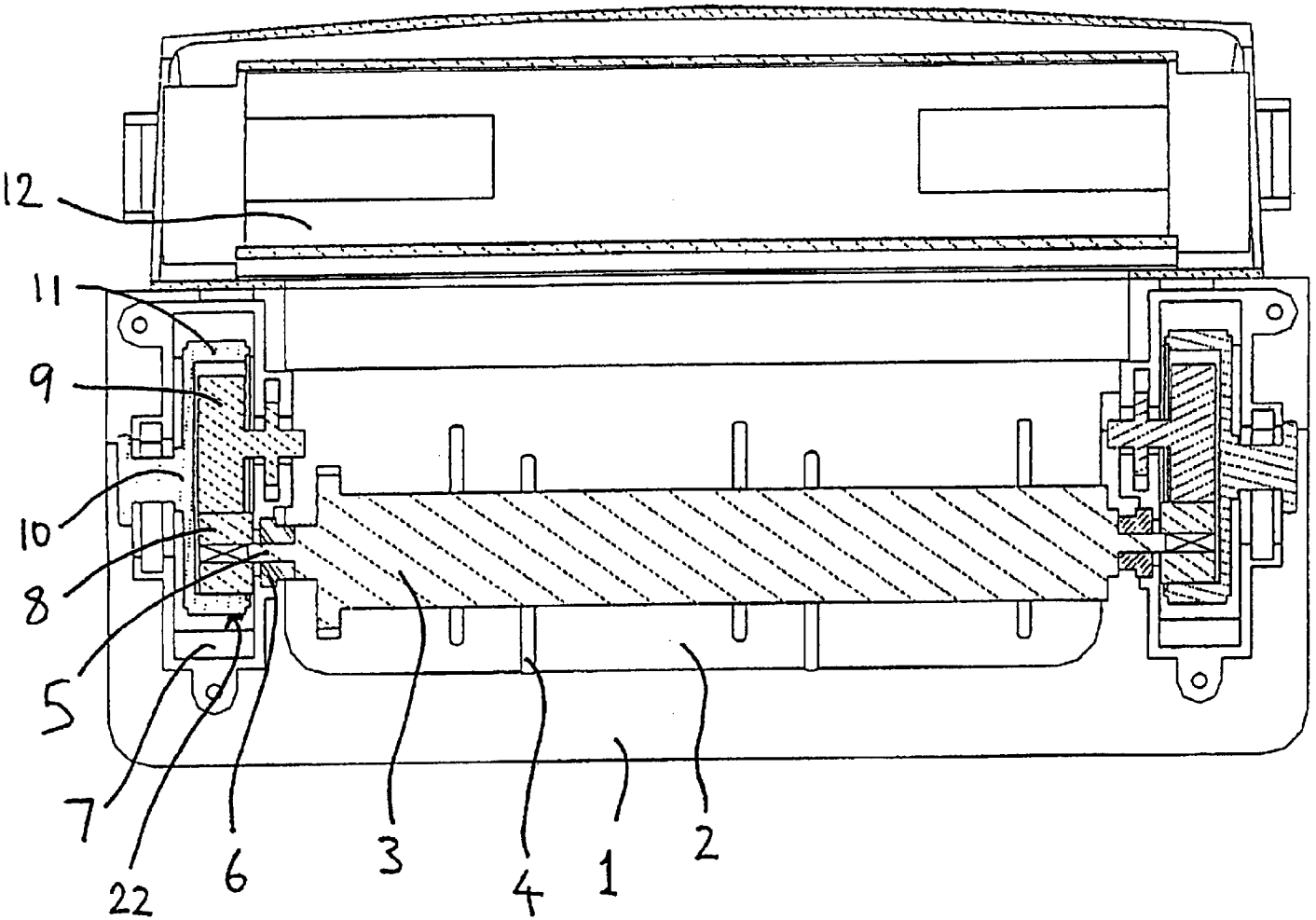
FIG. 2 is a section view through the floor sweeper of FIG. 1.

Referring to FIGS. 1 and 2, a manual sweeper comprises a housing 1 having an elongate opening 2 in its base. Disposed proximate the opening 2 is a brush roller 3 with a plurality of brush members 4 for sweeping a floor as the housing 1 is moved across the floor. Projecting from either end of brush roller 3 are stub shafts 5 which pass through bushes 6 fixed in the housing 1 for rotatably mounting the brush roller 3.

Either side of opening 2 the housing is provided with cavities 7 for enclosing a drive mechanism for brush roller 3. Cavities 7 are open at the base of housing 1 to so that the drive mechanism has a driving contact with the floor surface. Stub shafts 5 extend into cavity 7 and have mounted thereon a brush roller drive wheel 8. Also mounted within cavity 7 is a transmission friction wheel 9. In the preferred embodiment transmission friction wheel 9 is rotatably and slidably mounted so that it can move between a position engaged with brush friction wheel 8 and a position disengaged from brush friction wheel 8. However, is in alternative embodiments the transmission friction wheel 8 is rotatably mounted in permanent engagement with brush friction wheel 8.

A cup shaped driving friction wheel 10 is rotatably mounted in each cavity 7. The skirt 11 of driving friction wheel 10 is positioned about the brush friction wheel 8 and transmission friction wheel 9. The driving friction wheel 10 extends through the base opening of cavity 7 so that a driving surface 22 engages the floor surface to support the sweeper, and to rotate the driving friction wheel 10 in a first direction of rotation A when the sweeper is moved in a first direction of movement B across the floor surface, and to rotate the driving friction wheel 10 in a second direction of rotation C when the sweeper is moved in a second direction of movement D across the floor surface. The driving friction wheel 10 is also slidably mounted within cavity 7 so that when the sweeper is moved in the forward direction B friction wheel 10 moves to a first position in which the inner surface of skirt 11 engages the outer periphery of brush friction wheel 8. When the sweeper is moved in the second direction D the driving friction wheel 10 is moved to a second position in which the inner surface of skirt 11 engages the transmission friction wheel 9.

Located adjacent elongate opening 2 in base portion of housing 1 is a dust collection compartment 12.

Figure 3:
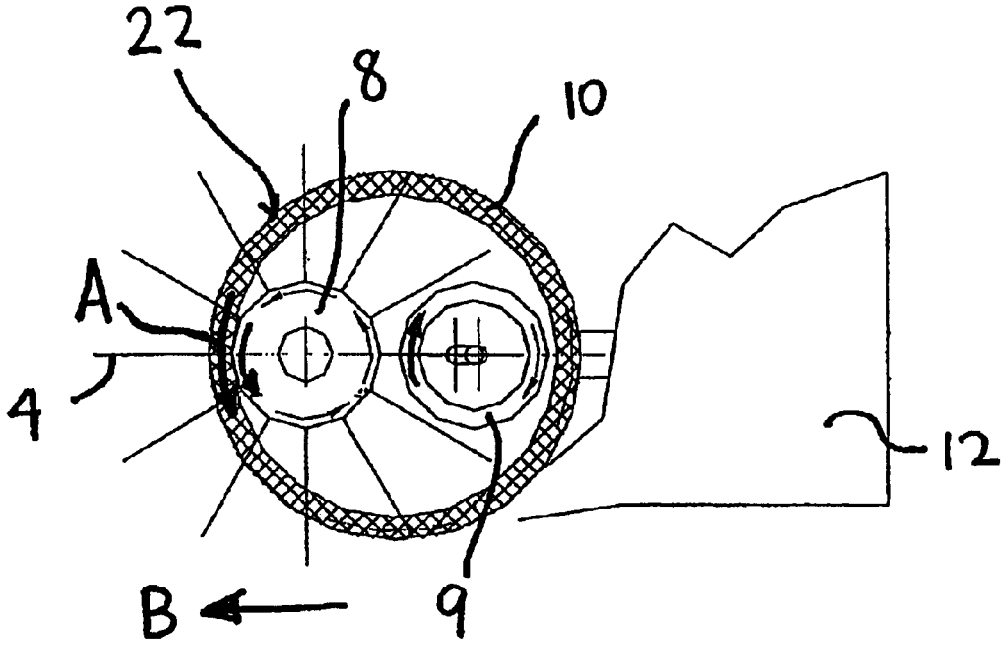
FIG. 3 illustrates operation of the sweeper moving in a first direction.

Referring to FIG. 3, when the sweeper is moved across the floor in the first direction of movement B the driving friction wheel 10 moves to the first position in which the inner wall of skirt 11 engages brush friction wheel 8. The driving friction wheel 10 rotates in the first direction A so as to cause brush roller 3 to move in a sweeping direction and brush members 4 sweep dirt and rubbish into dust collection compartment 12.

Figure 4:
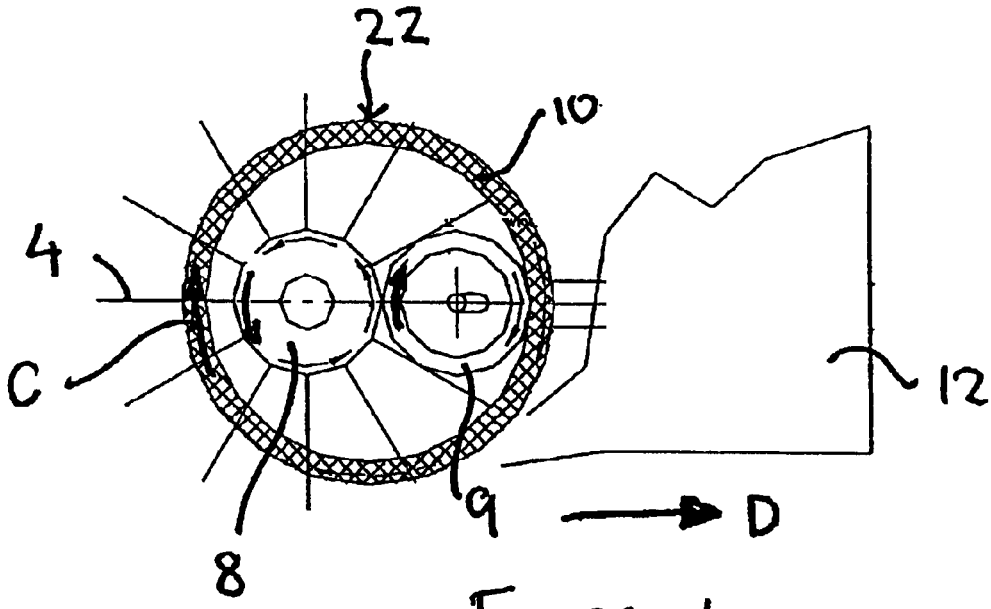
FIG. 4 illustrates operation of the sweeper moving in a second direction.

Referring to FIG. 4, when the sweeper is moved in the second direction D across the floor surface the driving friction wheel 10 moves to the second position in which inner wall of skirt 11 engages the transmission friction wheel 9. Transmission friction wheel 9 in turn engages with brush friction wheel 8 turning the brush roller 3 in the sweeping direction. Brush members 4 sweep dirt and rubbish into dust collection compartment 12.

The brush roller 3 is caused to rotate in the same sweeping direction regardless of the direction B, D of travel of the sweeper across the floor surface. Only one dust collection compartment is required.

The embodiment provides a manual sweeper with a single pair of driving wheels 10, a single brush roller 3 and one duct collection compartment 12. The roller brush 3 rotates in the same direction regardless of the direction of movement B, D of the sweeper. Opening 2 in the housing and the brush roller 3 are located proximate the front of the housing 1, which improves the effectiveness of the sweeper.

Figure 5:
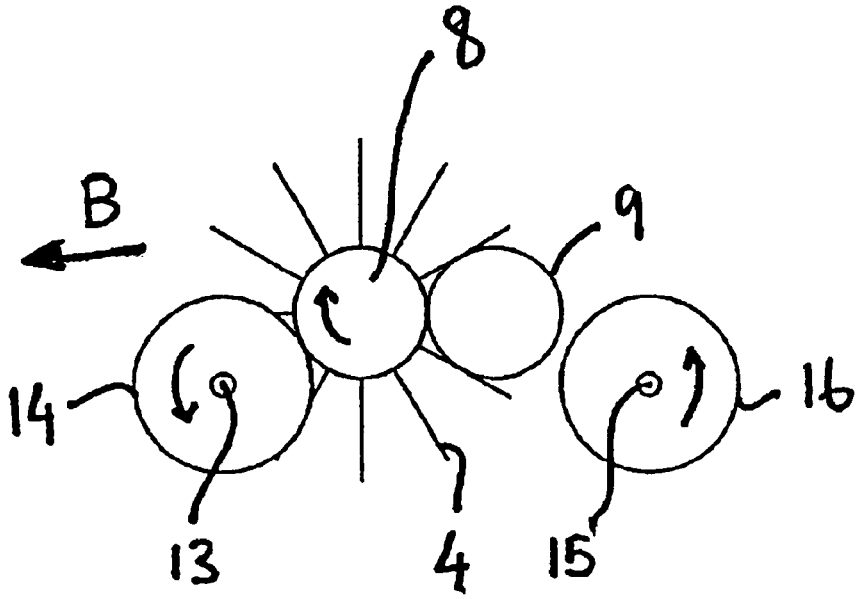
FIG. 5 illustrates alternative operation of the sweeper moving in a first direction.
Figure 6:
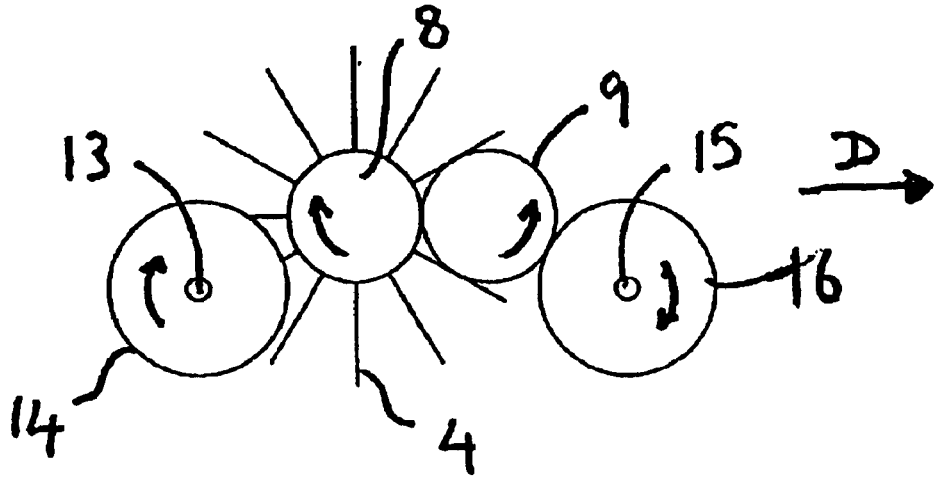
FIG. 6 illustrates alternative operation of the sweeper moving in a second direction.

It might be desirable to have a manual sweeper with a conventional four wheel arrangement. Referring to FIGS. 5 and 6, an alternative embodiment has a bogie comprising a first axle 13 carrying a first pair of wheels 14 and a second axle 15 carrying a second pair of wheels 16. The bogie is slidably mounted with housing 1. When the sweeper is moved in the first direction B the bogie moves to a first position wherein first wheels 14 engage brush friction wheel 8 rotating brush roller 3 in the sweeping 10 direction. When the sweeper is move in the reverse direction D across the floor surface the bogie moves to a second position wherein second wheels 16 engage the transmission friction wheel 9, which in turn engages brush friction wheel 8 turning brush roller 3 in the sweeping is direction.

Figure 7:
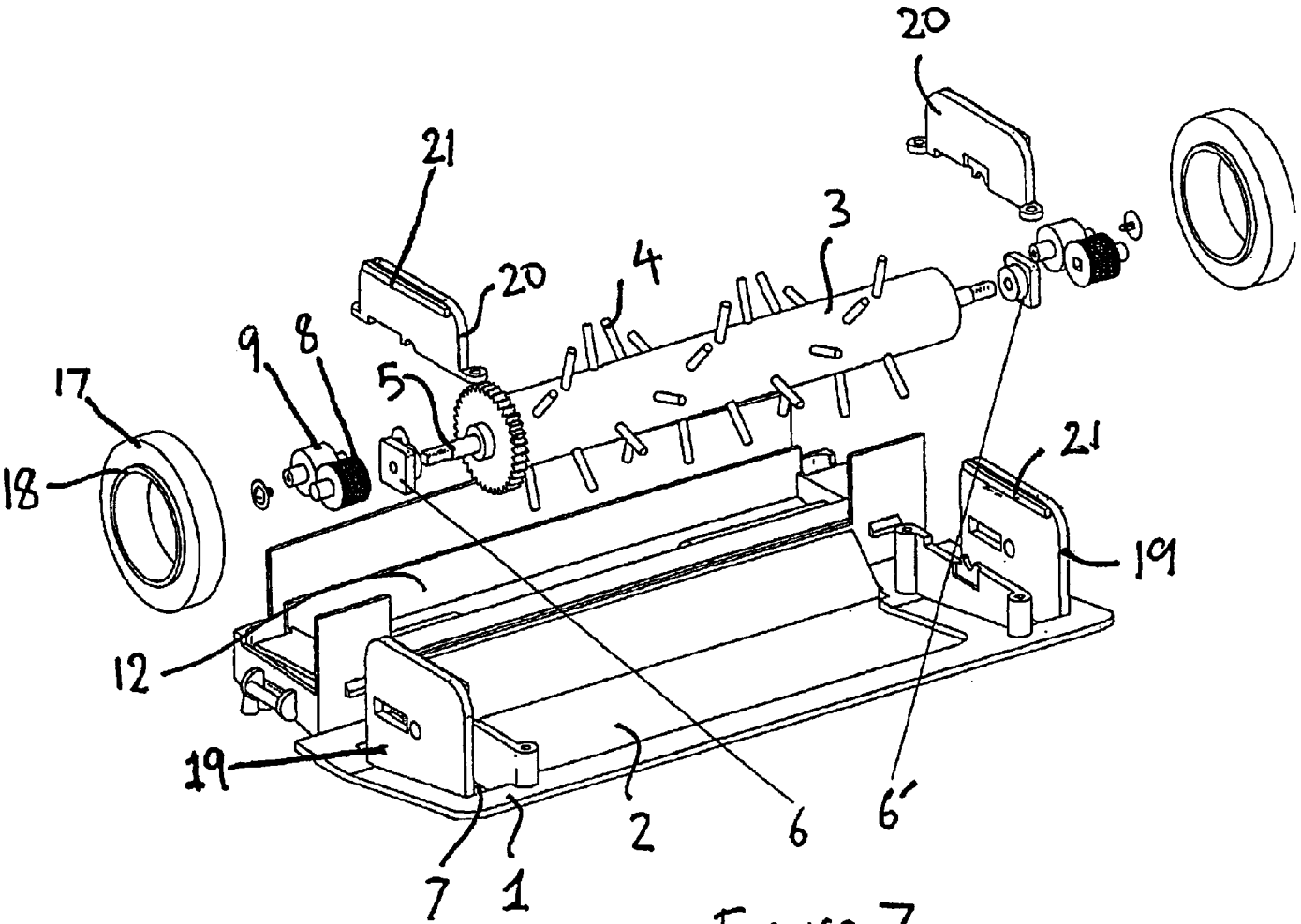
FIG. 7 is an exploded view of an alternative embodiment of a floor sweeper according to the invention.
Figure 8:
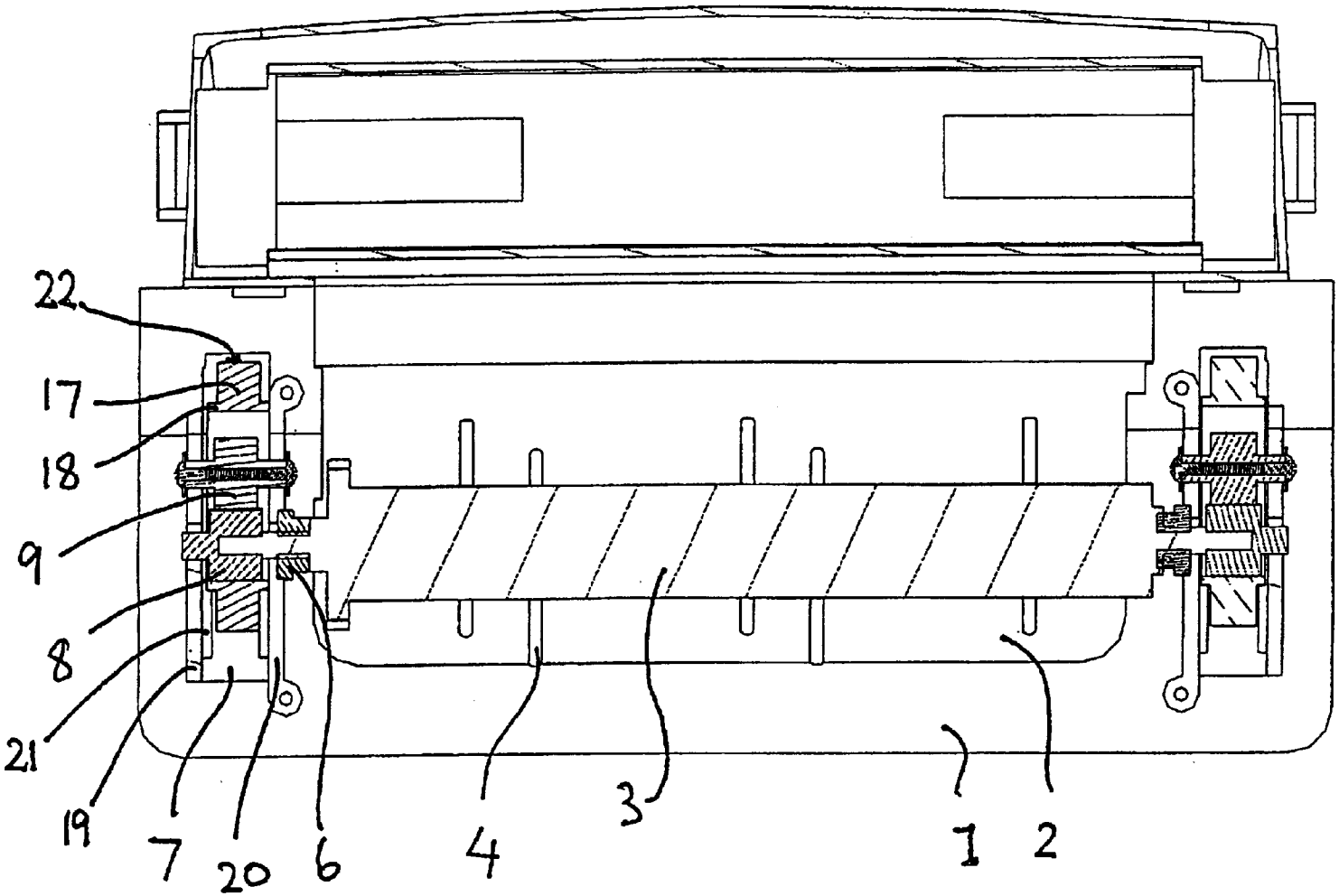
FIG. 8 is a sectional view through the floor sweeper of FIG. 7.

Referring to FIGS. 7 and 8, in another alternative embodiment the driving friction wheel is an annulus having guide rings 18 on its edges. The housing 1 base plate includes side plates 19, 20 either side of cavities 7. Driving friction wheel 17 is positioned about brush friction wheel 8 and transmission friction wheel 9 within cavity 17 and is floating therein. Guide ring 18 bears against inside surfaces of side plates 19, 20. Side plates 19, 20 include projecting rim 21 which bears against the top of guide ring 18 to vertically locate driving friction wheel 17 against the floor surface when the sweeper is use.

Where in the foregoing description reference has been made to integers or elements have known equivalents then such are included as if individually set forth herein.

Embodiments of the invention having been described, however it is understood that variations, improvements or modifications can take place without departure from the spirit of the invention or scope of the appended claims.

What is claimed is:

1. A manual floor sweeper including:

a housing;

a brush roller mounted within the housing and rotatable in a sweeping direction;

a first drive member fixed to the brush roller;

a second drive member mounted rotatably with the housing and engagable with the first drive member;

a drive carriage comprising a bogie having two axles and a wheel mounted at ends of each axle, wherein the drive carriage is movable between a first position for engaging the first drive member and a second position for engaging the second drive member so as to move the brush roller in the sweeping direction when the sweeper is moved in a first direction or a second direction.

* * * * *